US007154817B2

(12) United States Patent
Born et al.

(10) Patent No.: US 7,154,817 B2
(45) Date of Patent: Dec. 26, 2006

(54) ELECTRONIC APPARATUS INCLUDING AN ANALOGUE DISPLAY DEVICE FOR DISPLAYING ANY POSITION ON A DIAL

(75) Inventors: Jean-Jacques Born, Morges (CH); Raymond Froidevaux, Boudry (CH); Gilles Rey-Mermet, Le Landeron (CH)

(73) Assignee: Asulab S.A., Marin (CH)

( * ) Notice: Subject to any disclaimer, the term of this patent is extended or adjusted under 35 U.S.C. 154(b) by 359 days.

(21) Appl. No.: 10/730,890

(22) Filed: Dec. 10, 2003

(65) Prior Publication Data

US 2004/0120222 A1 Jun. 24, 2004

(30) Foreign Application Priority Data

Dec. 18, 2002 (CH) ..... 2167/02

(51) Int. Cl.
*G04B 19/04* (2006.01)

(52) U.S. Cl. ..... 368/80; 368/228

(58) Field of Classification Search ..... 368/80, 368/150, 15, 16–20, 223; D10/127–128
See application file for complete search history.

(56) References Cited

U.S. PATENT DOCUMENTS

| | | | | |
|---|---|---|---|---|
| 2,536,557 A | * | 1/1951 | Levesque | 368/234 |
| 4,266,288 A | | 5/1981 | Berney | |
| 5,299,177 A | | 3/1994 | Koch | |
| 5,422,864 A | * | 6/1995 | Lorello | 368/223 |
| 5,444,671 A | * | 8/1995 | Tschannen et al. | 368/10 |
| 5,500,835 A | | 3/1996 | Born | |
| 5,596,551 A | | 1/1997 | Born et al. | |
| 5,740,130 A | | 4/1998 | Grupp et al. | |
| 5,825,353 A | * | 10/1998 | Will | 345/184 |
| 6,154,421 A | * | 11/2000 | Solomon | 368/28 |
| 6,700,836 B1 | | 3/2004 | Satodate et al. | |

FOREIGN PATENT DOCUMENTS

| | | | | |
|---|---|---|---|---|
| CH | 684 044G A3 | | 7/1994 | |
| CH | 688 600G A3 | | 12/1997 | |
| JP | 54-127365 | | 10/1979 | |
| WO | WO01/55802 | * | 8/2001 | 368/76 |

OTHER PUBLICATIONS

European Search Report for Application No. EP 02 08 0624, dated Oct. 20, 2003.

* cited by examiner

*Primary Examiner*—Kamand Cuneo
*Assistant Examiner*—Sean Kayes
(74) *Attorney, Agent, or Firm*—Griffin & Szipl, P.C.

(57) ABSTRACT

The apparatus includes at least one information storing unit, a unit for processing said information, a management and control unit receiving control signals from the processing unit and a supply unit controlled by said management unit and controlling the movement of said two stepping motors above a dial bearing markings $R_i$ representative of said information.

The apparatus is characterized in that said processing unit is provided with an algorithm or correspondence table between a marking $R_i$ and angles $\alpha_i\beta_i$ formed respectively by each hand from a measurement reference and in that the shape of said hands is such that when they have the angular orientations $\alpha_i$ $\beta_i$, their elongated parts can intersect above said marking $R_i$, or their tips can be aligned opposite said marking $R_i$.

The apparatus may be a wristwatch.

15 Claims, 2 Drawing Sheets

ELECTRONIC APPARATUS INCLUDING AN ANALOGUE DISPLAY DEVICE FOR DISPLAYING ANY POSITION ON A DIAL

FIELD OF THE INVENTION

This application claims priority from Swiss Patent Application No. 2167/02, filed Dec. 18, 2002, the entire disclosure of which is incorporated herein by reference.

The present invention concerns a portable electronic apparatus comprising an analogue display device, i.e. a display device using hands for indicating a determined position on a dial, the position being representative of any time related or non-time related piece of information.

BACKGROUND OF THE INVENTION

This apparatus will be more particularly illustrated by the following description of a wristwatch which falls within the definition of a portable electronic apparatus with an analogue display device.

Electronic wristwatches whose hour, minute and seconds hands are driven by at least one stepping motor controlled by a time base and a microprocessor for displaying, in cooperation with the hour-circle, either the current time or another time related or non-time related piece of information upon an appropriate actuation of an external control member, are known. U.S. Pat. No. 4,266,288 discloses in its most elaborate embodiment, a timepiece including a single motor, a time base, a switch assembly and a control circuit for displaying either the current time or, upon actuation of an exterior control member, for driving both hands separately, the minute hand indicating for example the value of this time related or non-time related piece of information in cooperation with the hour-circle and the hour hand indicating the nature of the information inscribed on a ring in the vicinity of the hour-circle. The information may be, for examples an alarm time and its on or off state. U.S. Pat. No. 5,299,177 proposes an improvement wherein the hands are driven separately by two motors and cooperate in a first step by superposing each other to indicate, as mentioned above, the nature of the information, and then position themselves to indicate, in cooperation with the hour-circle, the value of said piece of information.

The freedom provided by the use of independent motors has inspired other modes of cooperation between the hands for displaying information other than, the current time.

In a non-limitative manner, U.S. Pat. No. 5,500,835 can be mentioned. This patent discloses a watch that can be set in a "weather forecast" mode, which is totally independent of the time base of the watch. In this "weather forecast" mode, the hour hand indicates in cooperation with one graduation arranged inside the hour-circle of the watch, an atmospheric pressure variation and the minute hand points towards pictograms which are drawn on the bezel and representative of a weather forecast as a function of the variation.

These documents enable thus time related or non-time related information to be displayed in cooperation with two graduations or even with three graduations if the seconds hand is also driven by an independent motor, but these documents do not suggest in any manner the designation of a piece of information located in any position on the dial.

U.S. Pat. No. 5,596,551 concerning a compass watch having the cardinal points born by the bezel and indicating the geographical north with respect to a selected direction with the aid of the minute hand, may also be cited. This patent discloses a second embodiment wherein the time related indications are transferred onto the bezel and wherein the dial comprises over three concentric rings names of places, for example names of cities, the latter being provided with markings. One could even imagine covering the entire dial with places and markings. These markings can be selected by the minute hand whose position is interpreted by a microprocessor which selects the magnetic declination of said place in a correspondence table, combines said declination with signals provided by magnetic sensors of the permanent magnet of the compass and commands the hour hand motor to move said hand in the direction of geographical north or in another predetermined direction such as the direction of Mecca. If one wishes to use such a watch in a reversible manner, it would be difficult to determine one's location using the minute hand, since places even far from each other may have similar or identical magnetic declinations, i.e. markings aligned along a same radius as Rome and Denver for example. Thus, this document does not in any way suggest how to designate any position on the dial in an unambiguous manner.

It is thus an object of the present invention to overcome the aforementioned drawbacks of the prior art, by proposing a portable electronic apparatus with an analogue display device provided with a device for indicating in an unambiguous manner any position over practically the entire the surface of a dial, this position being representative of any information, such as a time related different piece of information or a complementary piece of information to the current time, or a non-time related piece of information, or even a piece of information representative of a game exploiting this possibility of using the "whole dial" for analogue display.

SUMMARY OF THE INVENTION

Thus the invention concerns a portable electronic apparatus for displaying a piece of information in an analogue manner, by means of two hands driven independently by two stepping motors, the piece of information being represented on the dial via a plurality of markings $R_i$. This apparatus includes:

- at least one information storing unit,
- a unit for processing said information;
- a management and control unit receiving control signals from the processing unit,
- a supply unit controlled by the management unit, and controlling the movement of the two stepping motors;
- an external control members enabling at least the piece of information to be displayed.

This apparatus is characterized in that the processing unit is provided with an algorithm or a correspondence table between a marking $R_i$, located in any position on the dial and angles $\alpha_i$, $\beta_i$ formed respectively by each hand from a measurement reference and in that the shape of said hands is such that, when they have the angular orientations $\alpha_i$, $\beta_i$, their elongated parts can intersect above said marking $R_i$, or their tips can be aligned opposite said marking $R_i$.

The elementary shape of the hands may be a hand having a conventional shape for one hand and a broken contour for the second hand, the elbow of the second hand delimiting a neutral zone comprising no marks $R_i$. Both hands may also have a different broken contour. For aesthetical reasons, in particular in a wristwatch, the second hand may have a symmetrical shape such as for example, a heart shape with only one active branch.

In a preferred embodiment, the angular values $\alpha_i\beta_i$ are converted into a number of motor steps using a correspondence table or by the processing unit algorithm.

The nature of the information that can be displayed with the device of the invention may be very varied and the amount of information depends only on the dimensions of the dial and the limits of visual perception. One may, for example, display numbers or letters to form a game. In the case of a wristwatch, the apparatus further comprises a time base which may include a calendar forming the storing unit for displaying a second time related piece of information by distributing the dates and the months over the dial.

The device of the invention thus allows display of a large number of pieces of information in a more simple and economical manner than with a digital display device.

BRIEF DESCRIPTION OF THE DRAWINGS

Other features and advantages of the present invention will appear more clearly in the following description of embodiments given by way of non-limiting examples with reference to the annexed drawings, in which.

DETAILED DESCRIPTION OF THE ILLUSTRATIVE EMBODIMENTS

Figure 4:
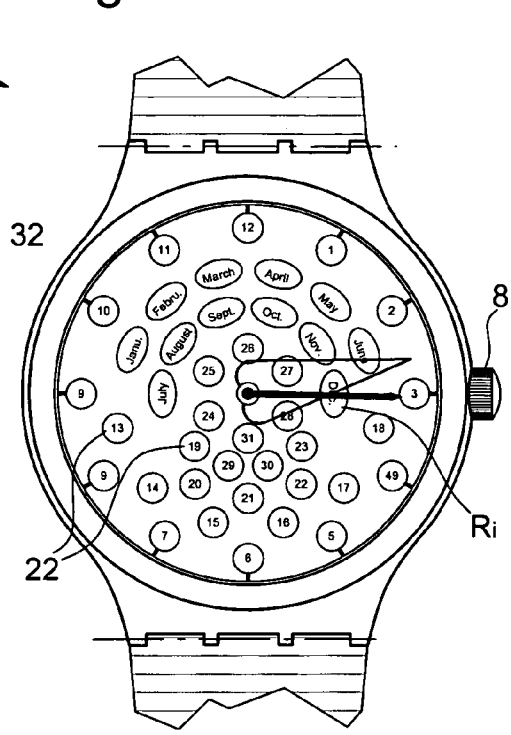
Figure 5:
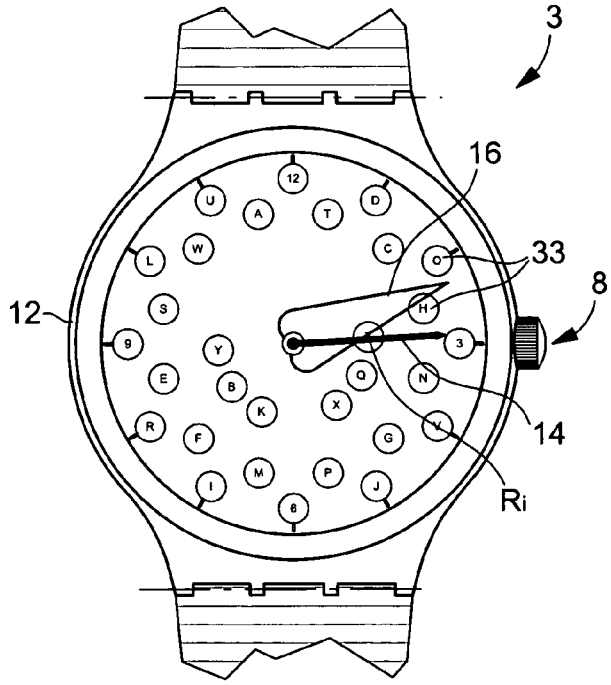
FIG. 5 shows a second embodiment example wherein the markings are formed by the letters of the alphabet.

In the following description, the portable electronic apparatus of the invention in the form of a wristwatch is designated by the general reference 1 (FIGS. 1 and 2), the general reference 2 (FIGS. 3 and 4) and the general reference 3 (FIG. 5).

Figure 1:
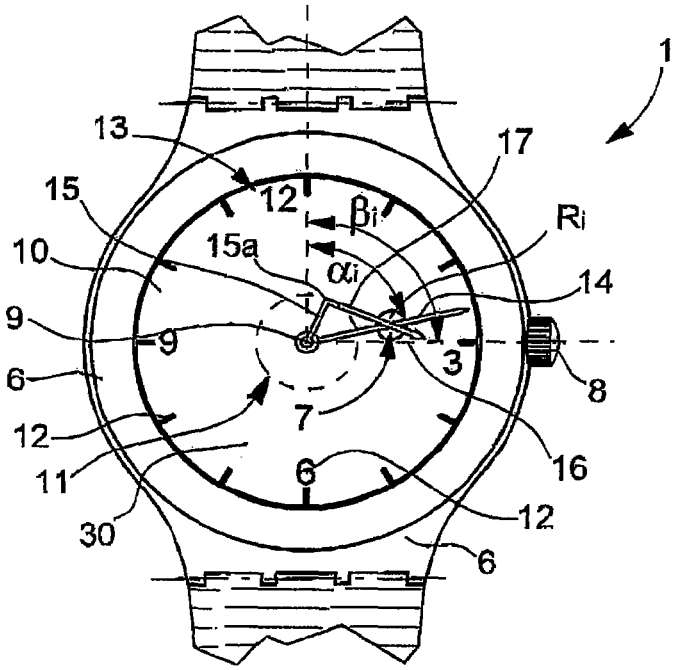
FIG. 1 shows the means for locating a position on a dial of a wristwatch according to the invention.
Figure 2:
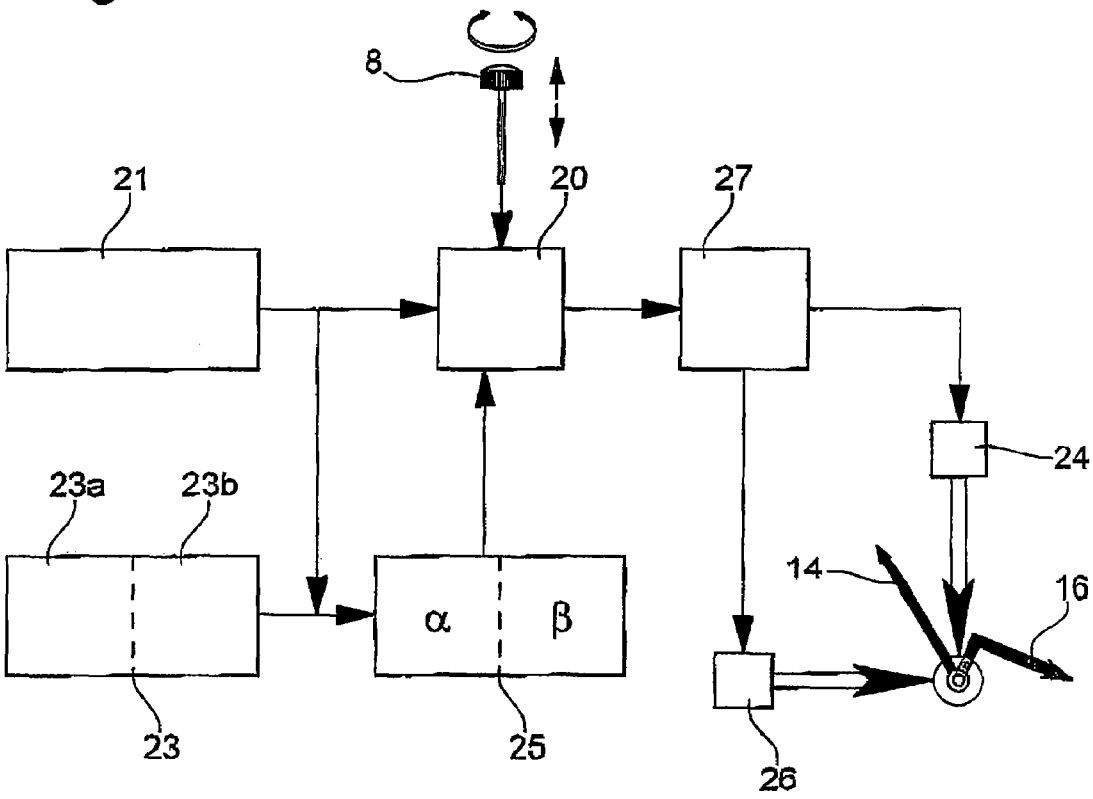
FIG. 2 is a general operating block diagram of the wristwatch shown in FIG. 1.

FIG. 1, which explains the principle of the invention, shows a wristwatch 1 comprising a case 6 incorporating an electronic circuit having a crown 8 as its exterior control member, said crown being able to be pulled or rotated in a known manner to select an operating mode. The wristwatch also comprises a dial 10, comprising hour-symbols 12 at its periphery, above which two hands 14, 16 are driven in rotation by two independent motors 24, 26 (FIG. 2).

It can immediately be seen that the hands have an "unusual" shape to achieve a technical goal even though this can coincide with concerns of aesthetic nature. The minute hand 14 is straight while the hour hand 16 is formed of two segments: a short segment 15, one end of which is attached to the driving center pipe 9 of the hour hand and the other end of which is bent to form an elbow 15*a* with a long segment 17. This particular configuration allows the long segment 17 of the hand 16 to intersect with hand 14 at one point 7 located along the entire length of segment 17, whatever its position above the dial, with the exception of a non-active zone located within the circle 11 described by elbow 15*a*.

In order to reduce the surface of the non-active zone 11, the "broken" shape may advantageously be replaced by a curved shape having a radius of curvature that decreases towards the center. For esthetical reasons both hands can be given the same symmetrical shape, bent or curved.

In order for intersection point 7 to sweep the dial 10 over the largest possible surface, the length of the base of the triangle formed by the bent hand 16 will be close to that of the minute hand 14. It will also be noted that this unusual configuration does not affect the accuracy of the current time reading, since minute hand 14 has a conventional configuration for reading a precise graduation on the hour-circle, the deviation of the tip of hour hand 16 still allowing the location of its position between two hour symbols 12. With regards to the legibility of the intersection of the hands above a marking Ri, the hands can advantageously be made in a translucent material in two different colors in order to produce a third color when they intersect. In FIG. 1, two angles measured from a reference, which is, in this example, the time reference 13 at 12 o'clock, have been illustrated. With respect to time reference 13 the angle $\alpha$ gives the position of the minute hand 14 with respect to a radius passing through the axis of rotation 9 of the hands and the tip of hour hand 16. Likewise, the angle $\beta$ gives the position of hour hand 16 although the angle formed by short segment 15 of hour hand 16 with time reference 13 could equally have been used.

The device thus represents a bipolar parametering of the quasi entire surface of the dial by means of angles $\alpha$ and $\beta$, each marking $R_i$ borne by the dial corresponding to a pair of values $\alpha_i$, $\beta_i$. For the time related indications or non-time related indications borne by the hour circle, their location results from the alignment of the tips of the hands corresponding to $\alpha_i=\beta_i$. Advantageously, $\alpha_i$, $\beta_i$ are not expressed by angular values but in the number of steps necessary to reach one of the angular values. By way of example, if one complete revolution of the hands represents 180 steps of the motor, with a dial 3 cm in diameter and hands bent at 90° leaving a neutral circle 1 cm in diameter, it is possible to form approximately 6000 different pairs $\alpha_i$, $\beta_i$. In practice, the number of markings $R_i$ is much more limited because of the limitations of the user's visual perception. By way of example, for a watch having the above mentioned characteristics, it is possible to have about 50 markings $R_i$ having a surface area of 12 $mm^2$.

In other words, if the electronic circuit adapted to the nature of the piece of information to be displayed via the markings $R_i$ is changed, it is possible to control the movement of hands 14, 16 to make them intersect or bring them into alignment above a marking $R_i$ representative of the precise piece of information to be displayed, as is briefly explained in connection with the general operating block diagram shown in FIG. 2.

The electronic circuit comprises a central management and control unit 20 whose operating mode depends on the manipulation of crown 8 and which receives time signals from a time base 21 in a conventional manner. The electronic circuit further comprises a storing unit 23 for the second piece of information and a processing unit 25 comprising a correspondence table containing, for each value $\alpha$ (respectively $\beta$), the marking(s) $R_i$ with which said value $\alpha$ is associated, so as to deliver the useful control signal to management and control unit 20 which then controls the supply unit 27 to drive motors 24 and 26 through a number of steps corresponding to the values $\alpha$ and $\beta$, thereby making hands 14 and 16 intersect or bringing them into alignment above said marking $R_i$. In a variant the correspondence table could be replaced by an appropriate algorithm.

Figure 3:
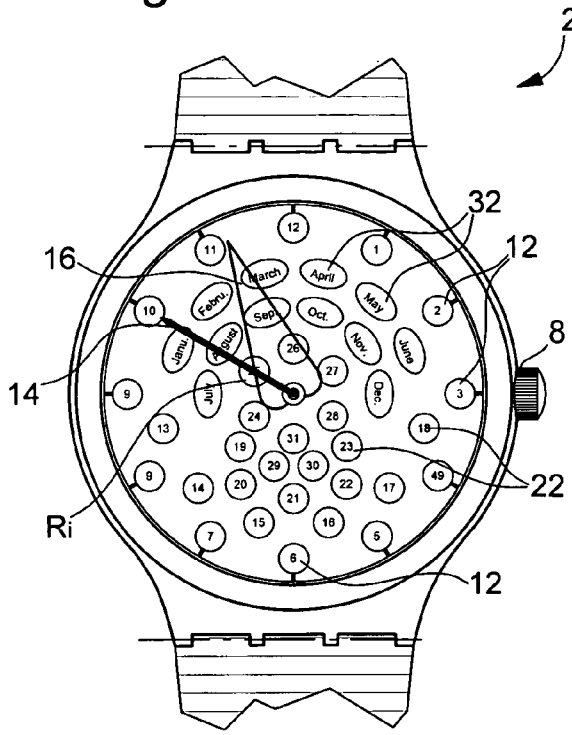
FIGS. 3 and 4 show a first embodiment example applied to a wristwatch with a calendar.

Referring now to FIGS. 3 and 4, a calendar watch 2 whose dial comprises, in addition to the numbers 1 to 12 corresponding to the hour symbols, the numbers 13 to 31 referenced by numeral 22 and the months of the year referenced by numeral 32 will be described hereinafter. Time base 21, containing registers for the dates and the months, and storing unit 23 form then one unit. By exerting pressure on crown 8, hands 14 and 16 will first cross each other above a marking $R_i$ for the date indication, i.e. the number "25" in FIG. 3, then above another marking $R_i$ for the month indication, i.e. "December" in FIG. 4. In this example, hand 16 is heart-shaped which gives a better aesthetical appearance and allows the size of the inactive zone at the center to be reduced. Of course, management and control unit 20 is programmed in order to recognize only one branch of the hear-shaped hand 16. It will also be noted that rectilinear hand 14 thus passes above the month of August and points towards the number 10, which corresponds to 150 steps of the motor from the time reference at 12 o'clock if one revolution of the hand corresponds to 180 steps. This means that the "value 150", corresponds in the correspondence table α to 10, August and 25. If the date to be displayed had been 10, i.e. the tips of the hands were alignmed, the "value 150" would also have correspond to the number 10 in the correspondence table β.

If one considers that such a heavy a dial is not attractive, it is possible to combine the dial with an optical valve 30 of the type described in U.S. Pat. No. 5,740,130 in order to mask the entire dial with the exception of the hour-symbols 12 in the normal operating mode.

FIG. 5, shows by way of illustration a game watch 3, which, by successive applications of pressure to crown 8 can select randomly, repetitively or not a letter of the alphabet, as is for example the case for the game called "the longest word". In the illustrated example, letter Z which was selected corresponds to the $26^{th}$ rank in storing unit 23 and has a value of 45 in the correspondence table α and 30 in the correspondence table β of processing unit 25.

Storing unit 23 may also comprise a sub-assembly, for example a sub-assembly 23*a* for the vowels and a sub-assembly 23*b* for the consonants, these sub-assemblies being able to be selected by rotating crown 8, an external control member, in one direction or the other. In this example, it is also possible to complete the electronic circuit of the apparatus with an electronic dictionary that can be consulted in order to check which is the longest word that could have been formed with the randomly drawn letters. In accordance with another embodiment, storing unit 23 contains the letters of the alphabet, corresponding to 26 marks distributed randomly on the dial and in the management and control unit is arranged so as to make a random selection of letters from the storing unit. In accordance with yet another embodiment, the portable electronic apparatus of the invention includes two storing units, one for the vowels and one for the consonants, each storing unit being able to be selected by an appropriate manipulation of the external control member 8. In still another embodiment of the invention, the portable electronic apparatus further includes an electronic dictionary that can be consulted on the basis of the letters selected from the storing unit 23. In another embodiment of the present invention, the portable electronic apparatus is a wristwatch able to permanently give a first time related piece of information and, upon actuation of the external control member, a second time related or non-time related piece of information.

Without departing from the scope of the present invention, those skilled in the art could envisage numerous other time related or non-time related type applications, such as a lottery game for the random and non-repetitive selection of a series of numbers marked on a dial, a roulette game which would correspond to 49 different game possibilities if excluding however combinations.

What is claimed is:

1. Portable electronic apparatus for displaying a piece of information in an analogue manner, by means of two hands driven independently by two stepping motors said piece of information being represented on the dial via a plurality of markings $R_i$, said apparatus including:

at least one information storing unit;

a unit for processing said information;

a management and control unit receiving control signals from the processing unit;

a supply unit controlled by said management unit, and controlling movement of said two stepping motors; and an external control member enabling at least said piece of information to be displayed;

wherein said processing unit is provided with an algorithm or a correspondence table between a marking $R_i$, located in any position on the whole surface of the dial, and angles $\alpha_i$ and $\beta_i$ formed respectively by each hand from a measurement reference wherein the shape of the hands is such that, when the hands have the angular orientations $\alpha_i$ and $\beta_i$, elongated parts of the hands can intersect above said marking $R_i$, or tips of the hands can be aligned opposite said marking $R_i$.

2. Apparatus according to claim 1, wherein at least one hand is bent and delimits in rotation a small central circle comprising no markings $R_i$.

3. Apparatus according to claim 1, wherein at least one hand has a curved shape with a radius of curvature decreasing towards the center of rotation of said hand.

4. Apparatus according to claim 3, wherein one hand is rectilinear and the other hand is heart-shaped, one branch of said other hand being active.

5. Apparatus according to claim 1, wherein both hands are made of translucent material in two different colors.

6. Apparatus according to claim 5, wherein a given value of an angle α or β corresponds separately to a determined number of steps of a stepping motor.

7. Apparatus according to claim 1, wherein the alignment of the tips of both hands corresponds to markings $R_i$ borne by the dial at a periphery of the dial.

8. Apparatus according to claim 1, wherein the apparatus further includes a time base supplying control signals to said management and control unit for displaying a first time related piece of information via said hands in connection with symbols provided at the periphery of the dial.

9. Apparatus according to claim 8, wherein said measurement reference for angles α and β is the time reference at 12 o'clock, said angles α and β being measured between the time reference and a radius passing through the rotational axis of said hands and through the tips of said hands.

10. Apparatus according to claim 8, wherein said time keeping circuit includes a calendar for the months and the dates, said calendar forming said storing unit for a second time related piece of information, and in that the markings $R_i$, are formed of the twelve months of the year and by the numbers from 1 to 31, the first twelve numbers corresponding to the hour-symbols.

11. Apparatus according to claim 8, wherein an optical valve is placed above the dial for masking the markings $R_i$ with the exception of the hour-symbols when the apparatus is in current time reading mode.

12. Apparatus according to claim 8, wherein said storing unit contains the letters of the alphabet, corresponding to 26 marks distributed randomly on the dial and in that said management and control unit is arranged so as to make a random selection of said letters from the storing unit.

13. Apparatus according to claim 12, wherein the apparatus includes two storing units, one for the vowels and one for the consonants, each storing unit being able to be selected by an appropriate manipulation of the external control member.

14. Apparatus according to claim 12, wherein the apparatus further includes an electronic dictionary that can be consulted on the basis of the letters selected from the storing unit.

15. Apparatus according to claim 12, wherein the apparatus is a wristwatch able to continuously give a first time related piece of information and, upon actuation of the external control member, a second time related or non-time related piece of information.

* * * * *